US006545410B1

(12) United States Patent
Wu et al.

(10) Patent No.: US 6,545,410 B1
(45) Date of Patent: Apr. 8, 2003

(54) FLAT PANEL DISPLAY OF A SEALING CHANNEL

(75) Inventors: Jiun-Han Wu, Sanchung (TW); Po-Cheng Chen, Yung-Ho (TW); Tzu-Pang Chieng, Tao-Yuan (TW)

(73) Assignee: AU Optronics Corp., Hsinchu (TW)

( * ) Notice: Subject to any disclaimer, the term of this patent is extended or adjusted under 35 U.S.C. 154(b) by 232 days.

(21) Appl. No.: 09/708,117

(22) Filed: Nov. 8, 2000

(30) Foreign Application Priority Data

Jul. 21, 2000 (TW) ..... 89114594 A

(51) Int. Cl.[7] ..... H01J 17/49; H01J 63/04; H01J 9/32

(52) U.S. Cl. ..... 313/582; 313/495; 313/634; 445/25; 445/24

(58) Field of Search ..... 313/581–582, 313/495–497, 605, 634; 445/24, 25

(56) References Cited

U.S. PATENT DOCUMENTS 5,600,203 A * 2/1997 Namikawa et al. ..... 313/292
5,670,843 A * 9/1997 Matsuura ..... 156/106
5,754,003 A * 5/1998 Murai et al. ..... 313/582
6,030,267 A * 2/2000 Browning ..... 313/495
6,129,603 A * 10/2000 Sun et al. ..... 313/495
6,312,302 B1 * 11/2001 Na ..... 445/24
6,479,944 B2 * 11/2002 Lee et al. ..... 315/169.4

* cited by examiner

*Primary Examiner*—Nimeshkumar D. Patel
*Assistant Examiner*—German Colón
(74) *Attorney, Agent, or Firm*—Winston Hsu

(57) ABSTRACT

A flat panel display includes a front substrate, a rear substrate parallel to and spaced apart from the front substrate for forming a gap between the front and rear substrates. A display area is positioned on the surface of the rear substrate facing the front substrate. The flat panel display further includes a plurality of barrier ribs positioned on the display area of the rear substrate, a first channel rib positioned on at least two sides of the display area of the rear substrate, and a second channel rib spaced from the first channel rib by a predetermined distance. The first channel rib and the second channel rib form a sealing channel. A sealing frit fills the sealing channel to seal together the front substrate and the rear substrate.

14 Claims, 5 Drawing Sheets

FLAT PANEL DISPLAY OF A SEALING CHANNEL

BACKGROUND OF THE INVENTION

1. Field of the Invention

The present invention relates to a flat panel display (FPD), and more particularly, to a flat panel display with a sealing channel filled with the sealing frit.

2. Description of the Prior Art

With the progressive development of the electronics industry, the demand for flat panel displays (FPD) has increased. The plasma display panel (PDP) has the greatest market potential amongst all FPDs. In the manufacturing process of a PDP, a front substrate is placed above a rear substrate, then these substrates are sealed together to form the discharge cell. The quality of the sealing process affects the yields of the subsequent processes for removing air and injecting the discharge gases from the PDP, and also influences the isolation of the discharge cells. Therefore, it is necessary to improve the reliability and quality of the sealing process.

Please refer to FIG. 1 and FIG. 2 which are the schematic diagrams of a plasma display panel 10 according to the prior art. The plasma display panel 10 includes a front substrate 12, and a rear substrate 14 parallel to and spaced apart from the front substrate 12 for forming a gap between the front substrate 12 and the rear substrate 14. A plurality of scanning electrodes 16, a dielectric layer 17, and a MgO layer 18 are formed on the front substrate 12. A display area 20 is defined on a surface of the rear substrate 14 that faces the front surface. Further, a plurality of barrier ribs 22 are positioned on the display area 20.

As shown in FIG. 1, in the sealing process of the front substrate 12 and the rear substrate 14, a sealing frit 24 is formed along the boundary of the display area 20 on the rear substrate 14. Then, a heating process is performed to sinter the sealing frit 24 so as to temporarily stabilize the sealing frit 24. As shown in FIG. 2, in the prior sealing method, a clamp 26 is used to hold the front substrate 12 and the rear substrate 14 tightly together in order to fix the distance between the front substrate 12 and the rear substrate 14. Furthermore, the front substrate 12 and the rear substrate 14 are placed into an oven of a temperature of approximately 450° C. In the process, the sealing frit 24 made of low melting point glass, melts to bond the front substrate 12 together with the rear substrate 14. After cooling, the front substrate 12 and the rear substrate 14 are tightly fixed and sealed together.

The sealing frit 24 is formed along the boundary of the display area. Prior to sintering, the sealing frit 24 is soft and disperses easily but lacks uniformity in height. Due to the uneven height of the sealing frit 24, a space exists between part of the sealing frit 24 and the front substrate 12, and the front substrate 12 can't be hermetically sealed with the rear substrate 14. The bonding strength between he two substrates becomes seriously affected and may cause gas leakage. As well, there is difficulty in the control of the coating path and the dispersion of the sealing frit powder. Moreover, positioning of the sealing frit 24 requires precise control, otherwise, the sealing frit 24 will pollute the display area 20 or other components. The clamp 26 requires the support of the barrier ribs 22 in the display area 20 for exerting some force in sealing the front substrate 12 with the rear substrate 14. However, the clamp 26 may rupture the MgO layer 18 in the display area 20 to influence the picture quality of the plasma display panel (PDP).

SUMMARY OF THE INVENTION

It is therefore an object of the present invention to provide a plasma display panel (PDP) having a sealing channel to solve the above-mentioned problems.

According to the present invention, the PDP includes a front substrate, a rear substrate parallel to and spaced apart from the front substrate for forming a gap between the front and rear substrates. A display area is positioned on the surface of the rear substrate that faces the front substrate. The plasma display panel further includes a plurality of barrier ribs positioned on the display area of the rear substrate, a first channel rib positioned on at least two sides of the display area of the rear substrate, and a second channel rib spaced from the first channel rib by a predetermined distance. The first channel rib and the second channel rib form a sealing channel. A sealing frit fills the sealing channel so as to seal the front substrate and the rear substrate together. Additionally, a joint notch can be formed on the front substrate. The position of the joint notch is opposite to the first channel rib and the second channel rib, so that top surfaces of the first and the second channel ribs are in contact with the surface of the joint notch. A plurality of grooves may additionally be formed on the top surface of the first or second channel ribs for increasing the effective sealing area of the sealing frit.

The sealing frit is formed in the sealing channel to eliminate the heating process used to temporarily sinter the sealing frit. The result prevents the destruction of the sealing frit during the sealing process and the sealing channel improves the uniformity of height as well as precisely controlling the position of the sealing frit. Hence, the yield and quality of the sealing process can be increased.

These and other objectives of the present invention will no doubt become obvious to those of ordinary skills in the art after reading the following detailed description of the preferred embodiment, which is illustrated in the various figures and drawings.

DETAILED DESCRIPTION OF THE PREFEERED EMBODIMENT

Figure 1:
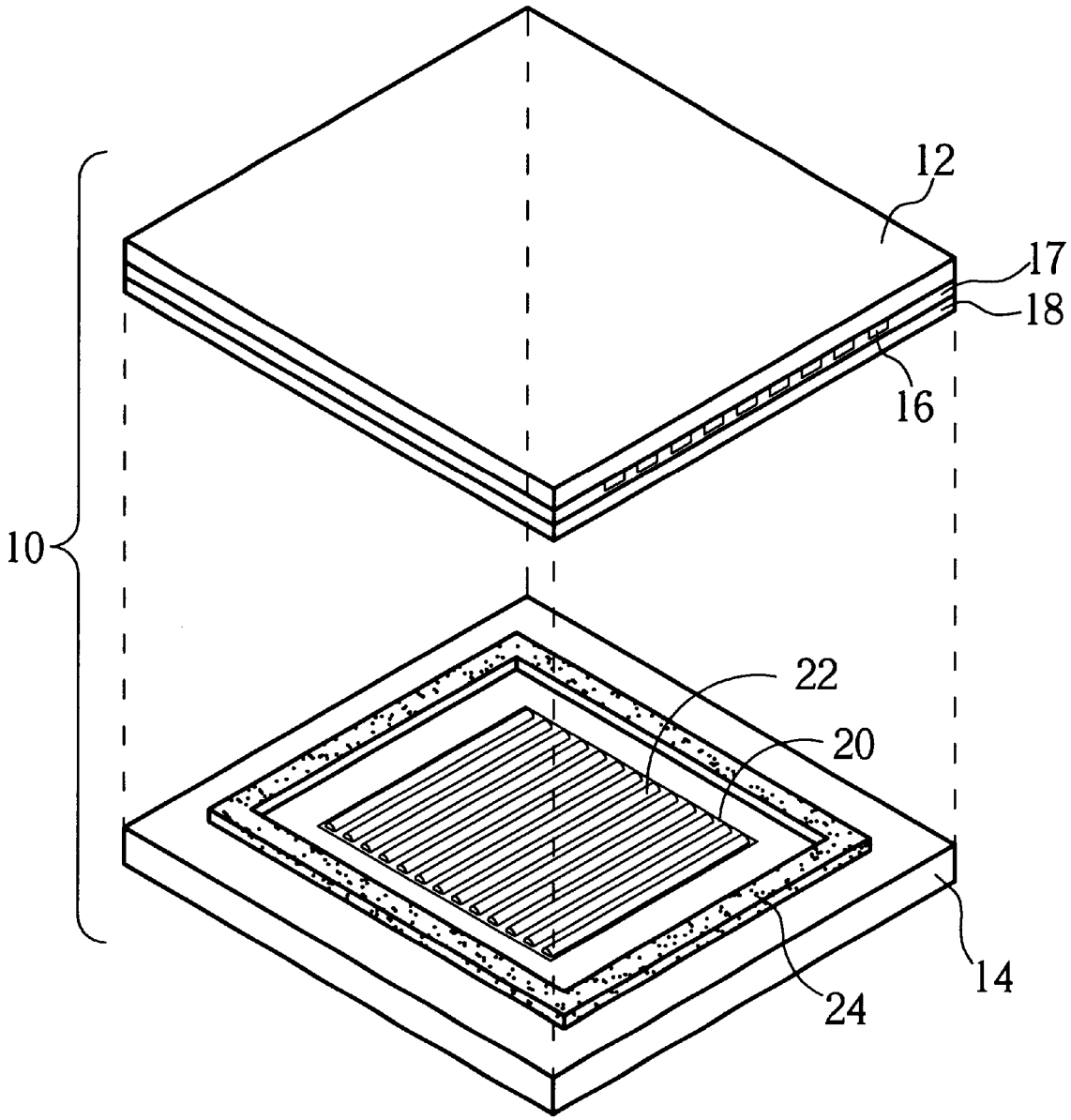
Fig. 1 Prior art
FIG. 1 is a schematic diagram of two substrates of a plasma display panel (PDP) according to the prior art.
Figure 2:
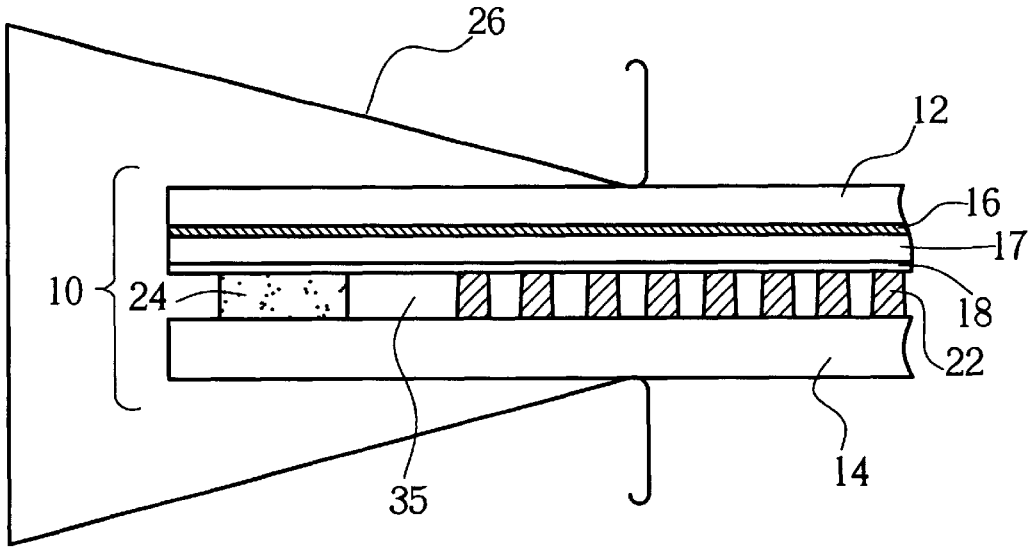
Fig. 2 Prior art
FIG. 2 is a cross-sectional diagram of a plasma display panel (PDP) according to the prior art.
Figure 3:
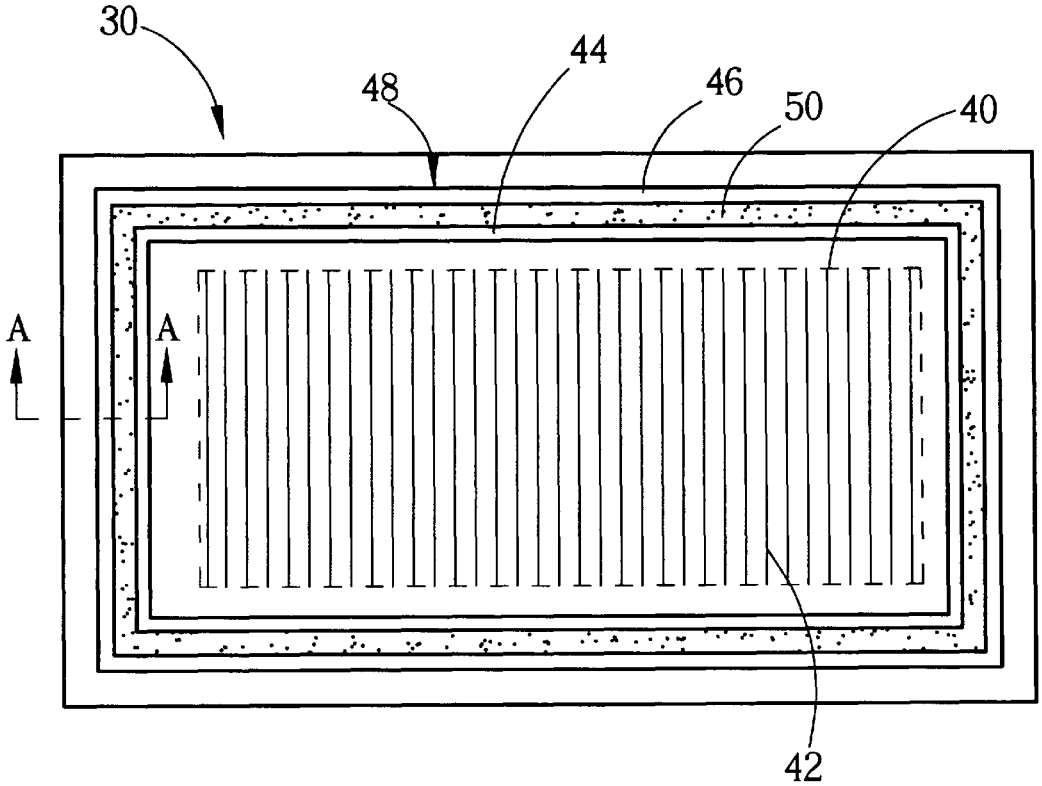
FIG. 3 is a top view of a plasma display panel according to the first embodiment of the present invention.
Figure 4:
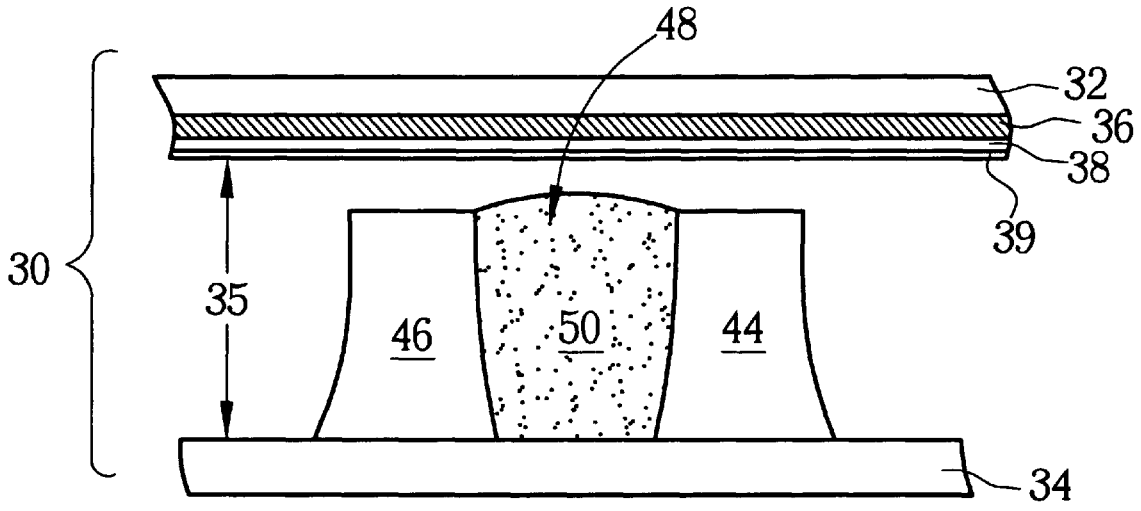
FIG. 4 is a sectional view along line A-A of the plasma display panel shown in FIG. 3.

Please refer to FIG. 3 and FIG. 4. FIG. 3 is a top view of a plasma display panel 30 according to the present invention. FIG. 4 is a sectional view along line A—A of the plasma display panel 30 shown in FIG. 3. As shown in FIG. 3 and FIG. 4, the plasma display panel 30 includes a front substrate 32, and a rear substrate 34 parallel to and spaced apart from the front substrate 32. A gap exists between the front substrate 32 and the rear substrate 34. A plurality of scanning electrodes 36 (not shown in FIG. 3), a dielectric layer 38, and a protective layer 39, usually composed of MgO, are formed on the front substrate 32. Besides, a display area 40 is defined on the surface of the rear substrate 34 that faces the front substrate 32. A plurality of barrier ribs 42 are formed in the display area 40.

The plasma display panel 30 also includes a first channel rib 44 and a second channel rib 46 positioned between the front substrate 32 and the rear substrate 34. Further, the first channel rib 44 is formed on the rear substrate 34 around the display area 40. The second channel rib 46 is also formed on the rear substrate 34 and is separated from the first channel rib 44 by a predetermined distance. A sealing channel 48 for receiving a sealing frit 50 is formed between the first channel rib 44 and the second channel rib 46. The sealing channel 48 and the barrier ribs 42 can be formed from the same process. In other words, the materials of the first channel rib 44, the second channel rib 46, and the barrier ribs 42 are the same.

The sealing frit 50 fills the sealing channel 48 to seal the front substrate 32 with the rear substrate 34. In the present invention, the first channel rib 44 and the second channel rib 46 form a rectangular shape to enclose the display area 40 of the rear substrate 34. The design of these channel ribs 44、46 can be changed according to the manufacturing process or circuit designs. The sealing channel 48 is not required to encompass the whole of the display area 40. For example, the sealing channel 48 may be formed on only the upper and the lower sides, on the left and the right sides, or other structures. In this preferred embodiment, the first channel rib 44 is parallel to the second channel rib 46, but the distance between the first channel rib 44 and the second channel rib 46 does not need to be fixed.

Figure 5:
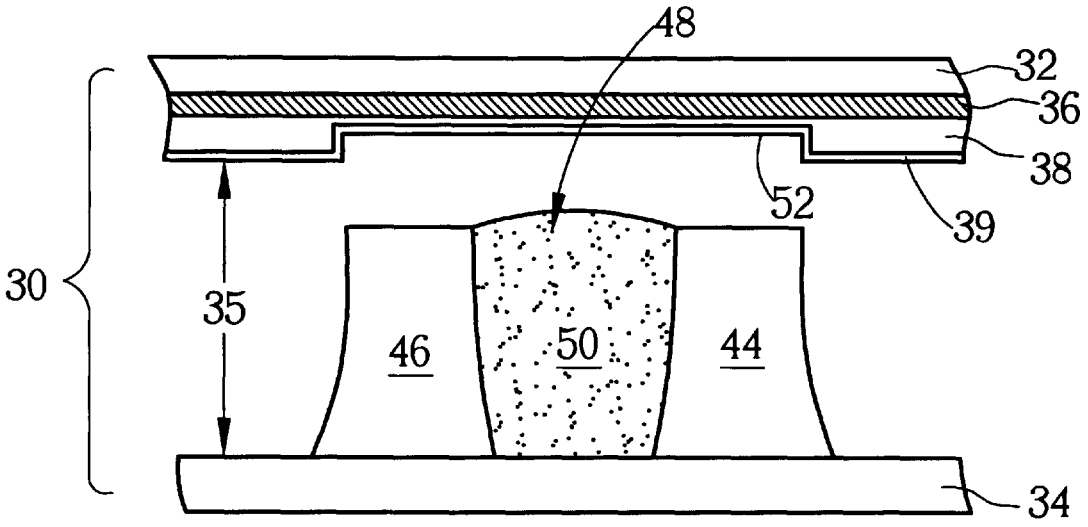
FIG. 5 is a sectional view of the second embodiment according to the present invention.

Please refer to FIG. 5 which shows a sectional view of the PDP 30 in the second embodiment of the present invention. As shown in FIG. 5, an additional joint notch 52 is formed on the front substrate 32. The position of the joint notch 52 is opposite to the first channel rib 44 and the second channel rib 46 so that the top surfaces of both the first channel rib 44 and the second channel rib 46 contact the surface of the joint notch 52. Because the joint notch 52 matches with the sealing channel 48, the bonding between the front substrate 32 and the rear substrate 34 becomes easy. Furthermore, the front substrate 32 can be precisely positioned with the rear substrate 34 to form a tight seal.

Figure 6:
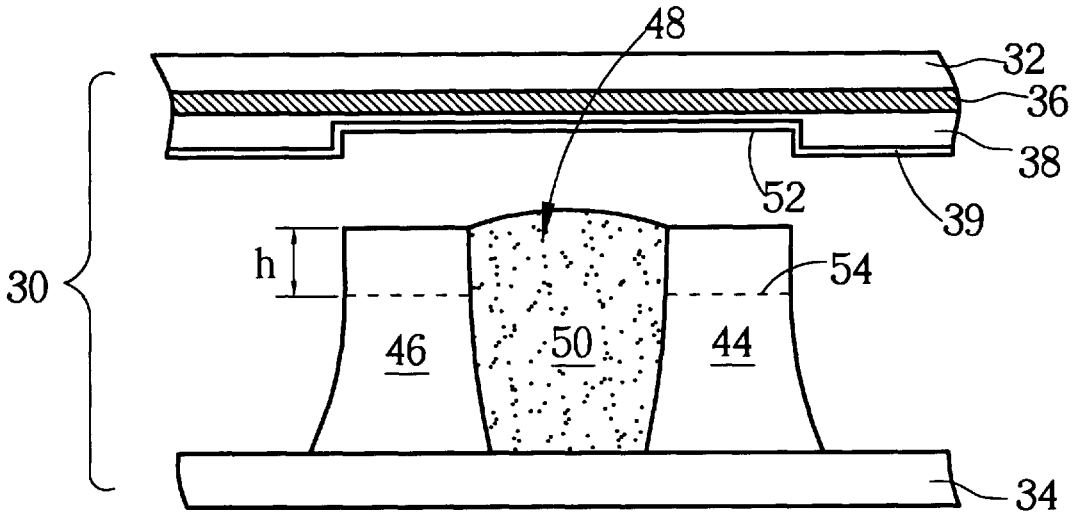
FIG. 6 is a sectional view of the third embodiment according to the present invention.
Figure 7:
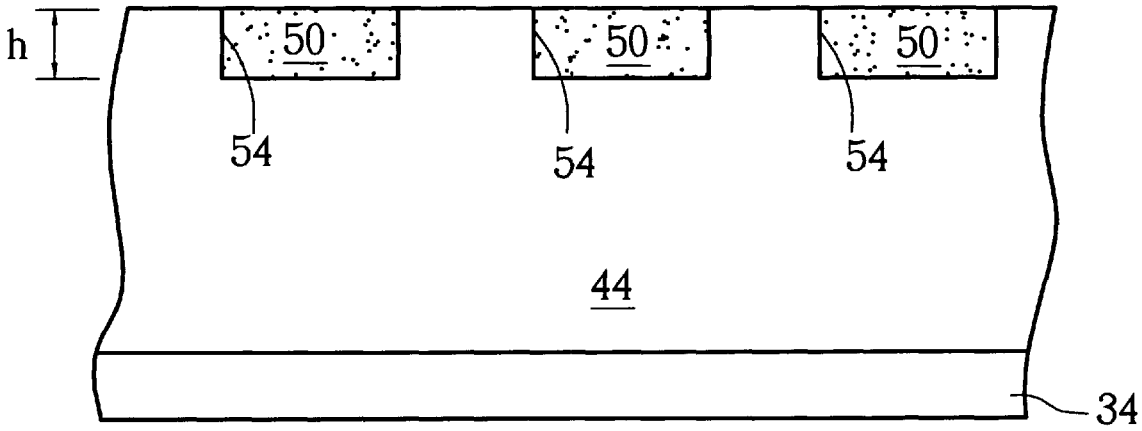
FIG. 7 is a sectional view of the channel rib shown in FIG. 6.
Figure 8:
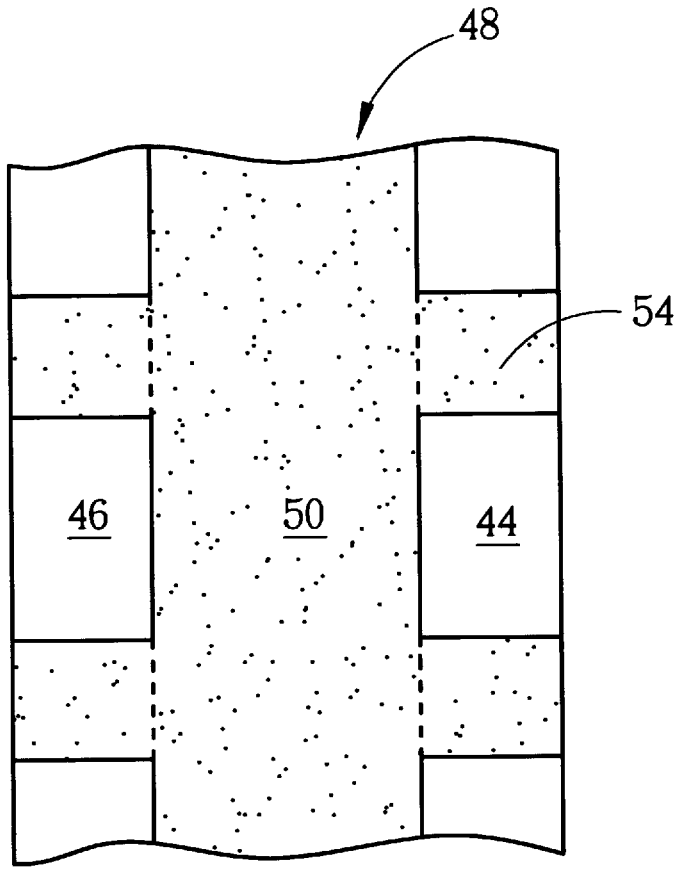
FIG. 8 is a top view of the channel rib shown in FIG. 6.

Please refer to FIG. 6 to FIG. 8. FIG. 6 is a cross-sectional view of the PDP 30 in the third embodiment of the present invention. FIG. 7 is a cross-sectional view of the first channel rib 44 shown in FIG. 6. FIG. 8 is a top view of the sealing channel 48. A plurality of grooves 54 having a depth of "h" are positioned on the first channel rib 44 and the second channel rib 46 of the plasma display panel 30. The grooves 54 connect with the sealing channel 48 so the sealing frit 50 is filled in the sealing channel 48 and the grooves 54. This increases the effective sealing area of the sealing frit 50 with the first and the second channel ribs 44 and 46. The shape and number of the grooves 54 may vary according to different designs. For instance, the lateral grooves 54 positioned on either side of the sealing channel 48 do not have to be symmetrical. The grooves 54 may also be positioned on only one of the channel ribs 44、46.

The feature of the PDP 30 of the present invention is that a sealing channel 48 is positioned to increase the uniformity of height of the sealing frit 50. The sealing channel 48 also functions to precisely control both the position and the boundary of the sealing frit 50. The sealing channel 48 and the joint notch 52 are used to increase the accuracy in bonding between the front substrate 32 with the rear substrate 34. As well, the sealing channel 48 acts to maintain the structure of the sealing frit 50 after its application on the rear substrate 34. Therefore, the heating process used to temporarily sinter the sealing frit 50 temporarily is no longer required. This simplifies the entire manufacturing process and reduces costs.

In the method of fabricating the plasma display panel 30, the front substrate 32 and the rear substrate 34 are fabricated separately. The scanning electrodes 36 and a dielectric layer 38 are formed on the front substrate 32. The barrier ribs 42 are then formed in the display area 40 on the rear substrate 34. A first channel rib 44 and a second channel rib 46 are formed along the display area 40 of the rear substrate 34. A sealing channel 48 is then formed between the first channel rib 44 and the second channel rib 46. To save time and cost, the first channel rib 44, the second channel rib 46, and the barrier ribs 42 are formed by the same process common methods of fabricating a rib, such as the printing process or the sand-blasting process, can be applied in the fabrication of a first channel rib 44 and a second channel rib 46.

In the present invention, both a photolithographic process and an etching process are used on the dielectric layer 38 of the front substrate 32 to form the joint notch 52. In the manufacturing of the grooves 54 in the third embodiment, a screen is used to design the pattern of the channel ribs 44、46. The channel ribs 44、46 are formed to a predetermined height by a printing process, and then another screen is used to design the pattern of the grooves 54 on the top of the channel ribs 44、46.

Figure 9:
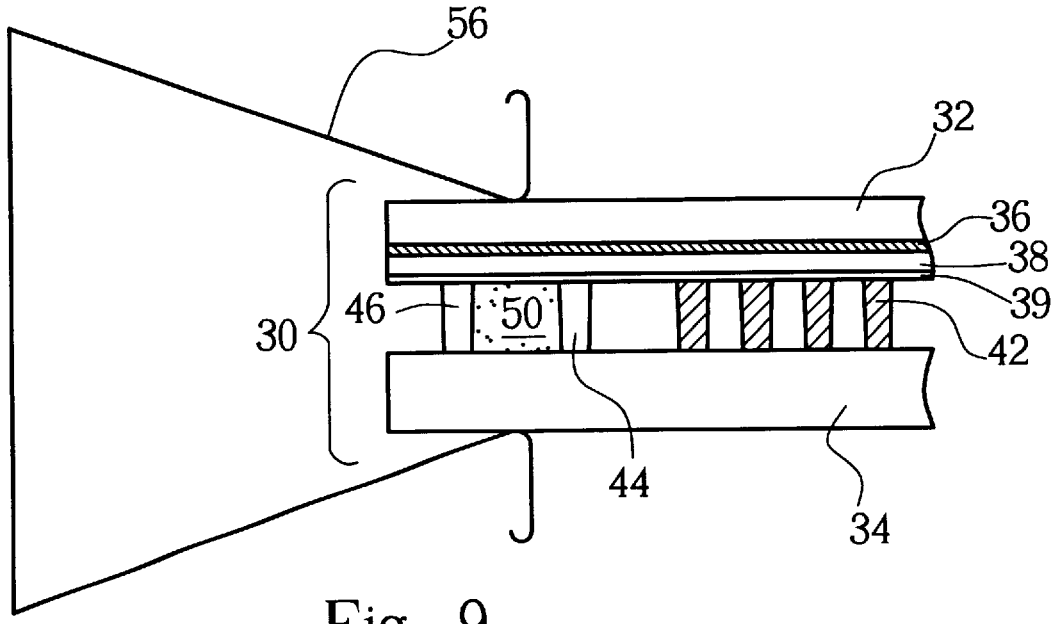
FIG. 9 is a schematic diagram of PDP clipped by a clamp.

Please refer to FIG. 9 which is a schematic diagram of the PDP 30 fixed by a clamp 56. The sealing frit 50 fills the sealing channel 48 after the sealing channel 48 is formed. The front substrate 32 is placed above the rear substrate 34 and a sealing process is performed to seal together the front substrate 32 with the rear substrate 34. As shown in FIG. 9, a clamp 56 is used in the sealing process to clip the front substrate 32 with the rear substrate 34. The clamp 56 is placed along the sealing channel 48, with the first channel rib 44 and the second channel rib 46 as supports for the sequential laminating process, to tightly seal together the front substrate 32 and the rear substrate 34. As a result, the dielectric layer 38 and the MgO layer 39 are not subjected to pressure by the clamp 56 to avoid damage of the layers 38 39.

In contrast to the prior art, the plasma display panel in the present invention has a sealing channel for receiving of the sealing frit. In the present invention, the use of the sealing channel not only eliminates the heating process for temporarily sintering the sealing frit, but also prevents the destruction of panels in the display area during the sealing process. Also, the sealing channel increases the uniformity of height of the sealing frit and precisely controls the position of the sealing frit along the boundary of the display area. As a result, both the yield and quality of the PDP are greatly increased. The present invention can be applied to various kinds of flat panel displays, such as a plasma display panel and a liquid crystal display.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel comprising:

a front substrate;

a rear substrate parallel to and spaced apart from the front substrate for forming a gap between the front substrate and the rear substrate, and the rear substrate having a display area positioned on a surface of the rear substrate that faces the front substrate;

a plurality of barrier ribs positioned on the display area of the rear substrate;

a first channel rib formed in the gap and positioned on at least two sides of the display area of the rear substrate;

a second channel rib formed in the gap and separated from the first channel rib by a predetermined distance to form a sealing channel therebetween; and a sealing frit formed in the sealing channel to seal the front substrate with the rear substrate;

wherein the sealing channel is used to define the position and the boundary of the sealing frit.

2. The plasma display panel of claim 1 wherein the front substrate further includes a joint notch, positioned opposite to the first channel rib and the second channel rib, so that the top surfaces of the first and the second channel ribs contact a surface of the joint notch.

3. The plasma display panel of claim 1 wherein the first channel rib further includes a plurality of grooves positioned on a top surface of the first channel rib, the grooves connecting with the sealing channel to increase an effective sealing area of the first channel rib with the sealing frit.

4. The plasma display panel of claim 1 wherein the second channel rib further includes a plurality of grooves positioned on a top surface of the second channel rib, the grooves connecting with the sealing channel to increase an effective sealing area of the second channel rib with the sealing frit.

5. The plasma display panel of claim 1 wherein the material of the first channel rib is the same as the material of the barrier ribs.

6. The plasma display panel of claim 1 wherein the first channel rib is of a rectangular shape and encompasses the display area of the rear substrate.

7. The plasma display panel of claim 1 wherein the first channel rib is parallel to the second channel rib.

8. A method for fabricating a plasma display panel, the plasma display panel comprising a front substrate and a rear substrate, the rear substrate having a display area positioned on a surface of the rear substrate that faces the front substrate, the method comprising:

(a) forming a plurality of barrier ribs in the display area of the rear substrate;

(b) forming a first channel rib and a second channel rib outside the display area, the first and the second channel ribs separated from each other by a predetermined distance to form a sealing channel;

(c) filling the sealing channel with a sealing frit; and (d) placing the front substrate above the rear substrate to seal together the front substrate and the rear substrate by the use of a sealing process;

wherein the sealing channel is used to increase the uniformity of height of the sealing frit and to define the dispersion boundary of the sealing frit.

9. The method for fabricating the plasma display panel of claim 8, comprising a step of forming a joint notch on the front substrate, positioned opposite to the first and second channel ribs, so that the top surfaces of the first and the second channel ribs contact a surface of the joint- notch.

10. The method for fabricating the plasma display panel of claim 8, wherein after step (b), a step comprises forming a plurality of grooves on a top surface of the first channel rib, the grooves connecting with the sealing channel to increase the effective sealing area of the first channel rib with the sealing frit.

11. The method for fabricating the plasma display panel of claim 8, wherein after step (b), a step comprises forming a plurality of grooves on a top surface of the second channel rib, the grooves connecting with the sealing channel to increase an effective sealing area of the second channel rib with the sealing frit.

12. The method for fabricating the plasma display panel of claim 8 wherein the material of the first channel ribs is the same as the material of the barrier ribs.

13. The method for fabricating the plasma display panel of claim 12 wherein the barrier ribs, the first channel rib, and the second channel rib are simultaneously formed.

14. The method for fabricating the plasma display panel of claim 8 wherein the sealing process clips the front and the rear substrates together by a clamp, the clamp positioned around the sealing channel and supported by the first and the second channel ribs to tightly fix the front substrate to the rear substrate.

* * * * *